United States Patent [19]

Mori et al.

[11] 4,263,696

[45] Apr. 28, 1981

[54] APPARATUS FOR DEPOSITING SLIVER INTO A SLIVER CAN

[75] Inventors: Mitsuo Mori, Toyota; Manji Nagai, Kariya; Isao Asai, Toyota, all of Japan

[73] Assignee: Kabushiki Kaisha Toyoda Jidoshokki Seisakusho, Aichi, Japan

[21] Appl. No.: 969,121

[22] Filed: Dec. 13, 1978

[30] Foreign Application Priority Data

Dec. 13, 1977 [JP] Japan ..... 52/149641

[51] Int. Cl.[3] ..... B65H 54/80

[52] U.S. Cl. ..... 19/159 R

[58] Field of Search ..... 19/159 R

[56] References Cited

U.S. PATENT DOCUMENTS

| | | | |
|---|---|---|---|
| 2,958,920 | 11/1960 | Erb | 19/159 R |
| 3,233,290 | 2/1966 | DeFore | 19/159 R |
| 3,302,955 | 2/1967 | Witzgall | 19/159 R |
| 3,407,446 | 10/1968 | Whitehurst | 19/159 R |
| 3,614,814 | 10/1971 | Araki et al. | 19/159 R |
| 3,638,278 | 2/1972 | Johnels | 19/159 R |

*Primary Examiner*—Louis Rimrodt

*Attorney, Agent, or Firm*—Sughrue, Rothwell, Mion, Zinn and Macpeak

[57] ABSTRACT

An apparatus for depositing sliver into a sliver can is comprised of a rotary turntable for supporting a sliver can. A cylinder having a piston slidable therein is vertically disposed beneath the center line of the turntable. A pressing rod is connected to the piston and a pressing plate is rotatably mounted on the top end of said pressing rod for engagement with a bottom plate of the can which is freely supported therein. An axial lost motion connection is provided between the pressing plate and the pressing rod and a coil spring is connected between the turntable and the pressing rod to couple the turntable and pressing rod plate together for rotation and for urging the turntable and pressing plate apart.

4 Claims, 3 Drawing Figures

APPARATUS FOR DEPOSITING SLIVER INTO A SLIVER CAN

BACKGROUND OF THE INVENTION

1. Field of the Invention

The present invention is directed to an apparatus for depositing sliver into a sliver can and more specifically to an arrangement for controlling the density of the sliver deposited into the can.

2. Prior Art

It is old and well known in the art to raise the bottom plate of a sliver can by means of a weight which is constant. Such an arrangement is shown in the U.S. Pat. No. to Defore 3,233,290.

It is also old and well known in the art to lower the bottom plate of a sliver can at a constant speed by a pantagraph mechanism which is driven by a rack and pinion. Such an arrangement is shown in the U.S. Pat. No. to Araki et al 3,614,814.

SUMMARY OF THE INVENTION

This invention relates to an apparatus for depositing sliver into a sliver can. The object is to provide an apparatus for depositing sliver into a sliver can which is simple, compact and low cost; by comprising such that an air cylinder deposited vertically under a turn table, its piston rod used as pressing rod, pressing plate rotatably mounted on the upper end portion of said pressing rod, said turn table and said pressing plate being connected by a spring.

DESCRIPTION OF THE PREFERRED EMBODIMENTS

Figure 2:
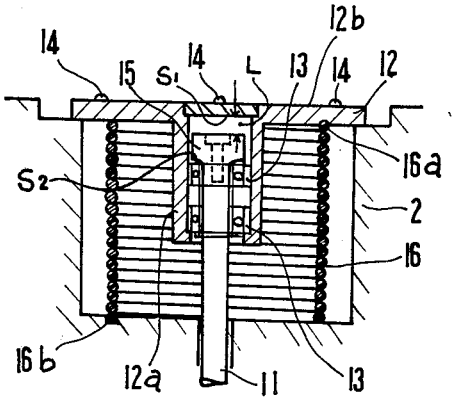
FIG. 2 illustrates an enlarged schematic vertical sectional view showing a mounting frame of a pressing rod and a pressing plate at the position where the pressing rod being moved in the lowest.
Figure 3:
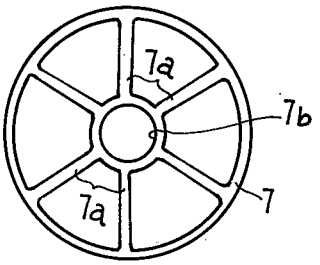
FIG. 3 illustrates a plane view of the back surface of the bottom plate only.

Referring now in detail to the figures of the drawing, reference numeral 1 is a machine frame. 2 is a turn table rotably supported on said machine frame. 3 is a can deposited on said turn table 2. 4 is a coiler wheel rotatably arranged at a position adjacent to the open top end of the can 3 having a guide tube 5 which guides a sliver, which is fed from a pair of calender rolls 6 just above the tube 5, into the rotating can 3. 7 is a bottom plate in the form of a vertically movable freely slidable disc in said can 3. As shown in FIG. 3, several ribs 7*a* are radially mounted on the back and a hole 7*b* for reducing air resistance is made in the center. When said can 3 is empty, said plate 7 contacts the under surface of said coiler wheel 4. Said plate 7 descends as said sliver is deposited between said coiler wheel 4 and said plate 7. As the sliver becomes full, the pressing rod 11 also descends into said turn table 2. 9 is an air cylinder which is fixed under the machine frame 1 such that it is located just under the center line of said turn table 2. It has an upper chamber A above a piston 10 and a lower chamber B under the piston 10. The pressing rod 11 is connected to piston 10. It can enter into said can 3 by penetrating the center of said turn table 2. 12 is a pressing plate in the form of a disc which is rotatably and slidably supported on the top portion of said pressing rod 11 through a pair of bearings 13, as shown in FIG. 2.

Several projections 14 are arranged in a circle of the upper surface of said plate 12. These projections make it possible for the plate 7 to be rotatably coupled with said plate 12 by contact with said ribs 7*a*. 15 is a stopper which is fixed to the top end of said pressing rod 11 with a screw, as shown in FIG. 2. Said stopper prevents said plate 12 from slipping off said pressing rod 11. Stopper 15 is located in a shaft portion 12*a* with the lower surface of said stopper in engagement with said bearing 13. 16 is a coil spring of which top end 16*a* is secured to the lower surface of said pressing plate 12 and bottom end 16*b* is secured to the bottom surface of a recess in table 2. Said spring 16 is expanded or compressed accordingly as said pressing rod 11 ascends or descends. Said spring can transmit the rotary motion of said turn table 2 to said pressing plate 12. Clearance L is provided so that said stopper 15 can slide vertically in the shaft 12*a* of said pressing plate 12. As shown in FIG. 2, an upper limit S1 of said clearance L is located at the position somewhat under the top portion 12*b* of said plate 12. A lower limit S2 of said clearance L is located at the position corresponding to the lowermost position of said stopper 15 on the condition that said pressing rod has descended to its lowermost position and the bottom end of said bearing 13 is contacted with the lower portion of said shaft 12*a*. As shown by the two point-dash line in FIG. 1, when said pressing rod 11 reaches its uppermost position, said plate 12 is urged upward by said spring 16 and the stopper 15 of said presing rod 11 ascends in clearance L provided in the shaft 12*a* of said plate 12 so that said stopper 15 is shifted to said upper limit S1 of clearance L. In other words, the plate 7 is pressed into contact with the lower surface of said coiler wheel 4 by providing clearance L.

Next, referring FIG. 1, the driving mechanism for the air cylinder 9 which can vertically move the pressing rod 11 of said air cylinder 9 and gives the surface pressure to the sliver which is being deposited in the can is explained as follows. 17 is a switch valve which is connected with a duct P1 and a duct P2. Said duct P1 is connected to the upper chamber A of said air cylinder 9. Said duct P2 is connected to the lower chamber B. 18 is a pressure air source which is connected via said duct P3 with said switch valve 17. 19 and 20 are pressure regulator and stopper valve respectively. 19 and 20 are connected in series with an intermediate portion of said duct P3.

Said pressure regulator 19 has a pressure meter 21. 22 and 23 are flow controllers which are connected with an intermediate portion of said duct P1 and an intermediate portion of said duct P2 respectively. The operation of the apparatus for depositing sliver into a sliver can constructed above will be explained.

Figure 1:
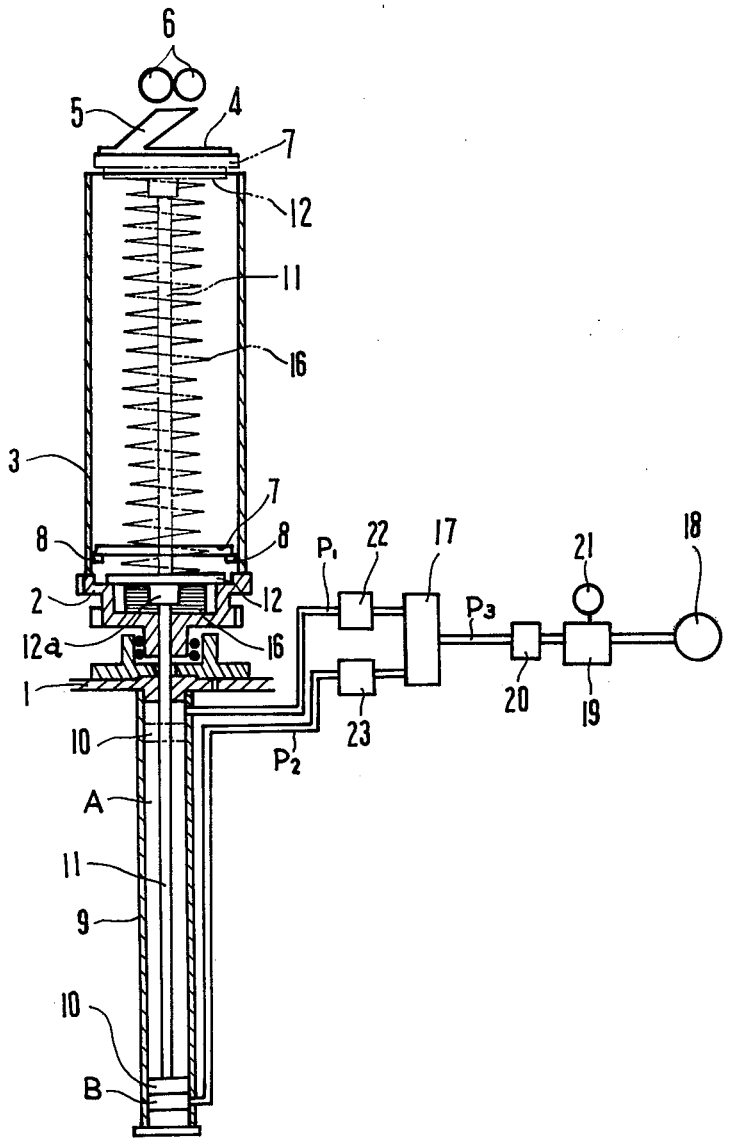
FIG. 1 illustrates a schematic vertical sectional view of an embodiment according to the present invention.

The two points—dash lines in FIG. 1 show the situation prior to the beginning of sliver coiling where the empty can 3 is deposited on the turn table 2, the pressure air has filled up the lower chamber B of the air cylinder 9 from the pressure air source 18 via the duct P3 and P2 whereby the pressing rod 11 is ascended, the pressing plate 12 is contacted with the bottom plate 7, said rod is extended to its uppermost position, and the bottom plate 7 is pushed up to the under surface of the coiler wheel 4 by the resilient force of the spring 16.

In this situation, the turn table 2, the can 3 and the coiler wheel 4 are rotated. As the pressing plate 12 and the bottom plate 7 are through the spring 16 the sliver which is fed from the calender rollers 6 is deposited into the can 3 through the guide tube 5 of said coiler wheel 4 while said sliver is coiled, pressed between said plate 7 and said wheel 4 by receiving the surface pressure of the pressing rod 11 and of the spring 16 from said plate 7, and then the density of this pressed sliver is raised and given the resilient force.

At this time the upper end of said pressing rod 11 has reached the upper limit S1 in the clearance L at the beginning of coiling when the surface pressure of said pressing rod 11 is given to said sliver through the bottom plate 7. In other words, it is the time when the bottom plate 7 and the pressing plate 12 descend and the under surface of the pressing plate 12 reaches at the top end of said stopper 15, as there is a clearance between said stopper 15 and said pressing plate 12.

Further the coiling is proceeding, after the resilient force of the sliver becomes to be stronger than the surface pressure from the bottom plate 7, the pressing rod 11 is gradually descended, maintainning the predetermined surface pressure, and the spring 16 is also gradually shrunk. Hereby, the pressure in the lower chamber B of the air cylinder 9 is heighten. When said air pressure exceeds the predetermined measure of the pressure regulator 19, the relief valve is actuated and it keeps said chamber B at predetermined measure. So, the pressure in said air cylinder does not change in spite of descending of the pressing rod 11. Therefore said pressing rod 11 descends smoothly. The more the weight of sliver deposited into the can increases, the less the surface pressure which is given to said deposited sliver by the air cylinder 9 is decreased. As the bottom plate 7 descends, shrinking the spring 16 gradually; the surface pressure increases gradually to the extent which the spring 16 is shrunk, the gradual decrease of the surface pressure of said plate 7 by the weight increase of the sliver is offset, and the surface pressure of said plate 7 is kept at predetermined measure. Therefore the sliver is pressed to a uniform density, and deposited into the can 3. After the can 3 is filled and the switch valve 17 is actuated, the duct P1 is connected to the duct P3, the pressure air is filled into the upper chamber A of the air cylinder 9 from the pressure air source 18 via the duct P3, P1, and at the same time, the pressure air in the lower chamber of said cylinder 9 is released from the flow regulator 23. Therefore, the pressing rod 11 is further overdescended than the position at the filling time of the sliver, the pressing plate 12 and the spring 16 are retracted inside of the turn table 2, as shown the solid line in FIG. 1, and then, the can 3 is exchanged in this situation.

After exchanging of the can 3, the switch valve 17 is actuated, the duct P2 is connected to the duct P3, the pressure air is filled into the lower chamber B of the air cylinder 9 from the pressure air source 18 via the duct P3, P2, and the bottom plate 7 arrives at the position prior to the beginning of the coiling as shown the two point-dash line in FIG. 1. At this time, the pressure air in the upper chamber A of the air cylinder 9 is released from the flow regulator 23.

As explained above, the pressed density of the sliver deposited into the can can be kept uniform, and the quantity of the sliver to be filled in the can is increased according to this invention. Furthermore, as in this invention, sure the pressing plate 12 is rotatably secured to the top end of the pressing rod 11, and sure the turn table 2 for the can 3 and the pressing plate 12 are connected with the spring 16; it is not necessary to rotate the pressing rod 11 by the rotation of the turn table 2. Therefore it is not necessary to provide a driving mechanism for rotating said pressing rod 11, and the construction can be simple. In order to keep the density of the sliver filled in the can uniform, it is necessary to increase gradually the pressure of the pressure air so that the surface pressure corresponding to the increase of the sliver depositing into the can as time goes by may be generated by the air cylinder. However as such apparatus becomes very compicated, the conventional apparatus is such that the changes of the pressure in each stages are given for convenience by assembling the multistage pressure regulator. According to this invention, such pressure changes are given by the spring, so the construction can be simple, and the cost of the apparatus also can be reduced. In this invention, the piston rod of the air cylinder is used as the pressing rod, so it is not necessary to provide the power transmission system, different from the conventional apparatus that comprises an air cylinder, a plurality of pressing rods provided for each delivery, a mechanism for combining the piston rod of said air cylinder and said pressing rods. In view of this fact, this invention also can make the apparatus simple, compact, and reduce the cost. Furthermore, in the conventional apparatus which uses an air cylinder per a frame, the surface presure of depositing sliver into the can is not necessarily the same among each delivery, because the surface pressure of depositing slivers into the cans is generated against the total resilient force of the slivers deposited into the cans in all deliveries. But this invention does not contain such deficiency, because an air cylinder are provided for each delivery.

In addition to the above features, this invention has another feature that needs only such a shallow and narrow pit in which the air cylinder may be accommodated. That is; though the conventional apparatus needed such a deep and wide pit that the guide means for the pressing rod, the chain for vertical movement, the chain wheel for said chain etc. may be accomodated; this invention needs only a shallow and narrow pit. In above embodiment, the clearance L is provided so that the stopper 15 of the pressing rod 11 may move freely in the shaft portion 12*a* of the pressing plate 12, so the bottom plate 7 can be pressed to the under surface of the coiler wheel 4 through the pressing plate 12 by the spring 16.

Therefore, the swinging projecting of the sliver at the time just after the beginning of the coiling can be prevented, and the stable operation (e.g. coiling) continuously can be maintained by absorbing the clearance error between the top end of the pressing rod 11 and the coiler wheel 4. In other words, as the stable operation can be maintained by the stable air pressure, the density of the sliver diposited into the can can be maintained suitable and uniform.

Therefore the quality of said sliver can be maintained suitable and uniform.

In above embodiment, though an air cylinder is used, of course, an oil cylinder can be used as the cylinder.

What is claimed is:

1. An apparatus for depositing sliver into a sliver can comprising a turn table for supporting a sliver can, a cylinder located under the center line of said turn table receiving said sliver can;

a piston slidable in said cylinder and having a pressing rod connected thereto;

a pressing plate rotatably mounted on the top end of said pressing rod, said pressing plate being engageable with a bottom plate of said can, said bottom plate being supported freely in said can;

a coil spring for connecting said turn table and said pressing plate together for rotation, said coil spring urging said turn table and said pressing plate apart, fluid pressure supply means, and means for supplying fluid pressure to said cylinder below said piston for raising said bottom plate of said can to the top of said can prior to introducing a sliver into said can including pressure regulating means for releasing fluid from said cylinder in response to an increase in pressure in said cylinder due to the increase in weight of said sliver on said bottom plate as said sliver is fed into said can to maintain uniform pressure in said cylinder so that the density of the sliver in said can will be uniform.

2. An apparatus for depositing sliver into a sliver can according to claim 1, wherein the rotatable connection between said pressing plate and said pressing rod is provided with a lost motion so that said pressing rod may slide vertically freely relative to said pressing rod, and the top end of said pressing rod is positioned a little under the lower surface of said pressing plate.

3. An apparatus for depositing sliver into a sliver can according to claim 1, wherein said cylinder is an air cylinder.

4. An apparatus for depositing sliver into a sliver can according to claim 1, wherein said cylinder is an oil pressure cylinder.

* * * * *